US005403446A

United States Patent [19]

Trelsmo et al.

[11] Patent Number: 5,403,446

[45] Date of Patent: Apr. 4, 1995

[54] APPARATUS FOR ADJUSTING CREPING CONDITIONS

[75] Inventors: Karin B. Trelsmo; B. Lennart H. Örtemo, both of Karlstad, Sweden

[73] Assignee: Valmet-Karlstad AB, Karlstad, Sweden

[21] Appl. No.: 936,602

[22] Filed: Aug. 27, 1992

[30] Foreign Application Priority Data

Sep. 2, 1991 [SE] Sweden ..... 9102498

[51] Int. Cl.[6] ..... B31F 1/14

[52] U.S. Cl. ..... 162/281; 15/256.51

[58] Field of Search ..... 162/111, 269, 263, 280, 162/281, 198; 15/256.53, 256.51

[56] References Cited

U.S. PATENT DOCUMENTS

| | | | |
|---|---|---|---|
| 2,669,360 | 2/1954 | Little | 15/256.51 |
| 3,778,861 | 12/1973 | Goodnow . | |
| 4,281,434 | 8/1981 | Sullivan | 15/256.53 |
| 4,434,522 | 3/1984 | Linzberger | 15/256.51 |
| 4,558,658 | 12/1985 | Sommer et al. | 118/411 |
| 4,642,839 | 2/1987 | Urban | 15/256.53 |
| 4,906,335 | 3/1990 | Goodnow | 162/281 |
| 4,919,756 | 4/1990 | Sawdai . | |
| 5,021,124 | 6/1991 | Turtinen et al. | 162/281 |
| 5,221,351 | 6/1993 | Esser et al. | 118/419 |

*Primary Examiner*—W. Gary Jones
*Assistant Examiner*—Brenda Adele Lamb
*Attorney, Agent, or Firm*—Bell, Seltzer, Park & Gibson

[57] ABSTRACT

A creping doctor apparatus includes a creping doctor (4) having a doctor blade (5) with a working edge (6). The creping doctor (4) is pivotable around a rotational axis (12) formed substantially at the working edge (6) to permit adjustment of an impact angle (A) formed at the working edge (6) between an impact surface of the blade edge and the cylindrical surface (2) of a Yankee dryer (3), from which an adhering paper web (1) is to be creped off. The impact angle (A) controls the result of the creping operation, e.g. the caliper and/or the macrostructure of the soft crepe paper web produced, but wear of the working edge (6) gradually causes a change in the impact angle (A) and, thereby, in the creping conditions. To maintain the desired caliper and/or the desired macrostructure as far as possible it is necessary to compensate for the wear of the working edge (6) by pivoting the creping doctor (4) substantially around the working edge (6) so as to maintain the impact angle (A). Circularly arched guide means (20), which have a radius of curvature (R) starting from a desired location of said rotational axis (12) substantially at the working edge (6), are provided for guiding the pivotal movement of the creping doctor (4). The disclosed apparatus is compact, oscillatable and mechanically stable and can readily be substituted for an existing conventional creping doctor.

9 Claims, 10 Drawing Sheets

APPARATUS FOR ADJUSTING CREPING CONDITIONS

TECHNICAL FIELD

The present invention relates to an apparatus for adjusting the creping conditions when creping off a paper web by means of a creping doctor from a paper machine creping surface to which the paper web adheres, said creping doctor having an elongate doctor blade with a working edge and mounted in a bladeholder and extending across the width of the web, said apparatus having means for defining a first rotational axis for the creping doctor parallel to the blade working edge and located at a distance from the creping surface to permit the blade to be pivoted to an active first position for creping off the web and an inactive second position, in which a worn blade may be removed from the bladeholder and a fresh blade inserted thereinto, said apparatus further having means for pivoting the creping doctor on said first rotational axis, means for defining a second rotational axis parallel to the blade working edge for permitting the setting of an arbitrary impact angle formed at the blade edge between an impact surface of the blade edge and the creping surface, and means for pivoting the creping doctor on said second rotational axis to set the impact angle.

BACKGROUND OF THE INVENTION

An apparatus of this type is disclosed in U.S. Pat. No. 4,919,756 (Sawdai). The doctor blade is mounted in a bladeholder secured to a shaft extending parallel to the tip of the doctor blade. Each shaft end extends through a bearing in a two-armed impact-angle-adjust lever having one arm end pivotable in a pillow block located in alignment with the tip of the doctor blade. Axially outside the impact-angle-adjust lever a tipping lever is fixed to the shaft. An actuating cylinder is provided for swinging the tipping lever and, consequently, tipping the bladeholder between an active first position, in which the blade tip contacts the cylindrical surface of a Yankee dryer, and an inactive second position, in which a worn blade may be replaced. A jackscrew is connected between another pillow block and the other arm end of the impact-angle-adjust lever for pivoting the doctor blade around its tip. By continually adjusting the angular position of the doctor blade it is possible to reduce deleterious effects of doctor blade wear on the creping process by maintaining a substantially constant impact angle, and/or to substantially minimize the deleterious effects on a physical property of the paper web, e.g. the machine-direction tensile strength of the web, which would otherwise be caused by doctor blade wear. The disclosed apparatus has means for automatically continually adjusting the angular position of the doctor blade, and these adjusting means comprise means for being programmed with an empirically derived functional relation between the desired amount of doctor blade rotation and time.

The disclosed adjustable doctor utilizes a lever system of low mechanical stability. To avoid vibrations, which have a deleterious effect on the doctor apparatus and on the creped tissue paper produced, it would have to be considerably sturdier. Further, in order to minimize the forming of grooves in the cylinder surface of the Yankee dryer the doctor should be oscillated axially. An oscillation of the doctor is not provided for in the disclosed doctor apparatus and it would also require the apparatus to be able to absorb lateral forces. A modification of the disclosed adjustable doctor apparatus to overcome the above drawbacks would result in a space-requiring apparatus. An additional drawback is that it can not readily be substituted for an existing conventional doctor, because the attachments for the mounting of the doctor to a frame member of the paper machine are different.

SUMMARY OF THE INVENTION

The object of the present invention is to provide an adjustable creping doctor apparatus, which is compact and of a sufficient mechanical stability and which readily can be substituted for an existing conventional creping doctor.

According to the invention this object is achieved by providing an apparatus of the kind initially stated with an elongate beam member included in the creping doctor and having two ends, said bladeholder being carried by the beam member, said means for defining the first rotational axis including two coaxial pivot pin devices connected to the beam member, one at each end thereof, and means associated with the pivot pin devices for supporting the same, said supporting means being adapted to be secured to a frame member of the paper machine, each pivot pin device and its associated supporting means forming a pair, and each pivot pin device including a pivot pin and an end wall non-rotatably and perpendicularly secured to the pivot pin, said end walls being located parallel to each other, one immediately outside each end of the elongate beam member, said means for defining the second rotational axis including means for guiding a lateral displacement of the beam member in a direction parallel to the two end walls, said guiding means including, for each pair of beam member end and associated end wall, structural portions that define a first guide member of elongated shape extending along a circular arc having a radius of curvature, which starts from the desired location of the second rotational axis, and a cooperating second guide member adapted to the shape of the first guide member, said two guide members being interlocking to permit movement of the one in relation to the other exclusively along said circular arc, one of said guide members being provided on the beam member and the other guide member being provided on the end wall, thereby forming a pivotal connection (around the axis) between each pivot pin device and the beam member ends, said means for pivoting the creping doctor on the second rotational axis being operatively connected between the beam member and the end walls for displacing the beam member in a lateral direction parallel to the end walls, and said means for pivoting the creping doctor on the first rotational axis being supported by the paper machine frame member and operatively connected to rotate the pivot pins.

Such an apparatus is mechanically stable and compact, and as it is based upon a conventional creping doctor it can readily be substituted for an existing conventional creping doctor, since the existing attachment points in the paper machine frame structure can be utilized.

Preferably said means for pivoting the creping doctor on the second rotational axis include two rotary to translatory motion transforming mechanisms, one located at each end of the beam member, each mechanism comprising a housing pivotally secured to the beam member; an elongate positioning member extending through the housing, said positioning member having one end non-rotatably and pivotally secured to an adjacent one of said two end walls of the pivot pin devices in a position such that the positioning member extends substantially parallel to a tangent to said guiding means; and means for displacing said positioning member longitudinally in relation to the housing. Thereby, the risk of pinching or jamming of the guiding means is reduced.

To accomplish a desired precision in the setting of the impact angle, it is suitable that said mechanism is a screw jack, and said positioning member is a positioning screw included in the screw jack.

It is also suitable to provide means for mechanically interconnecting the two motion transforming mechanisms in a manner such that a longitudinal displacement of one of the positioning members causes a corresponding longitudinal displacement of the other one. Such means make it possible to manually adjust the impact angle by rotating a hand-wheel, for example, in case an electronic system for the control of the impact angle should not operate properly.

In order to prevent the formation of grooves in the cylinder surface of the Yankee dryer it is suitable to provide bearing means for permitting axial oscillation of the creping doctor relative to the supporting means, said bearing means being provided in association with each of the pivot pin devices and the adjacent supporting means.

Preferably, each bearing means includes a bushing that is axially displaceable on a portion of the pivot pin, and said supporting means includes a self-aligning bearing having an inner ring, which is mounted on the bushing, and an outer ring, a surrounding housing in which the outer ring is mounted, and a bracket member to which the housing is secured, said bracket member being intended to be secured to said frame member of the paper machine. Thereby, a compact structure is obtained with the bearings protected inside the housing.

To avoid bending forces that might tend to deform the guiding means and cause a change in the fit between the first and the second guide member it is suitable that said pivot pin device supporting means include two self-aligning bearings, which are associated one with each of the two coaxial pivot pin devices, each of said self-aligning bearings has a central symmetry plane extending perpendicularly to the first rotational axis for the creping doctor, and each of said driven members has a center line, said center lines being located one in each of the two central symmetry planes of the two self-aligning bearings.

It is preferred that said first guide member is a guide slot, and said second guide member is a guide rail adapted to the shape of the guide slot. Thereby, a reliable and mechanically simple design is obtained.

As an alternative, said first guide member is a guide slot, said second guide member includes two rows of guide rollers, and said guide slot has two opposed side walls extending parallel to each other and forming raceways for the guide rollers of said two rows. The substitution of guide rollers for the guide rail may be desirable to some users to reduce friction in the guiding means.

Additional features that characterize the invention and what is achieved by means of these features will be disclosed below.

DETAILED DESCRIPTION OF THE PREFERRED EMBODIMENTS

Figure 1:
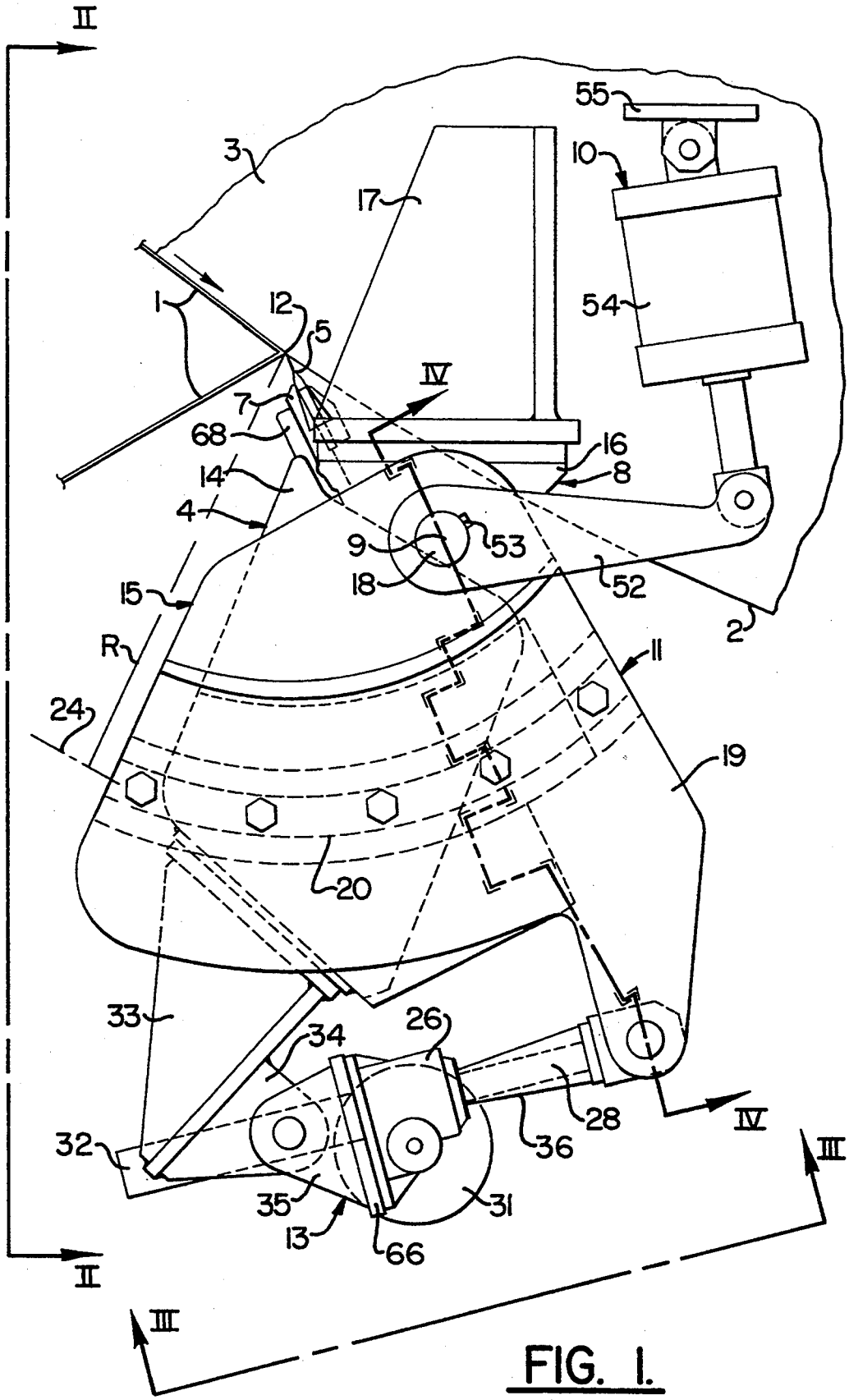
FIG. 1 is a slightly simplified side elevational view of a preferred embodiment of a creping doctor apparatus used for creping off a paper web from the cylinder surface of a Yankee dryer, and which apparatus incorporates means for pivoting the apparatus on a first rotational axis so as to permit blade exchange and means for pivoting the creping doctor substantially around the tip of the doctor blade so as to permit adjustment of the impact angle.
Figure 2:
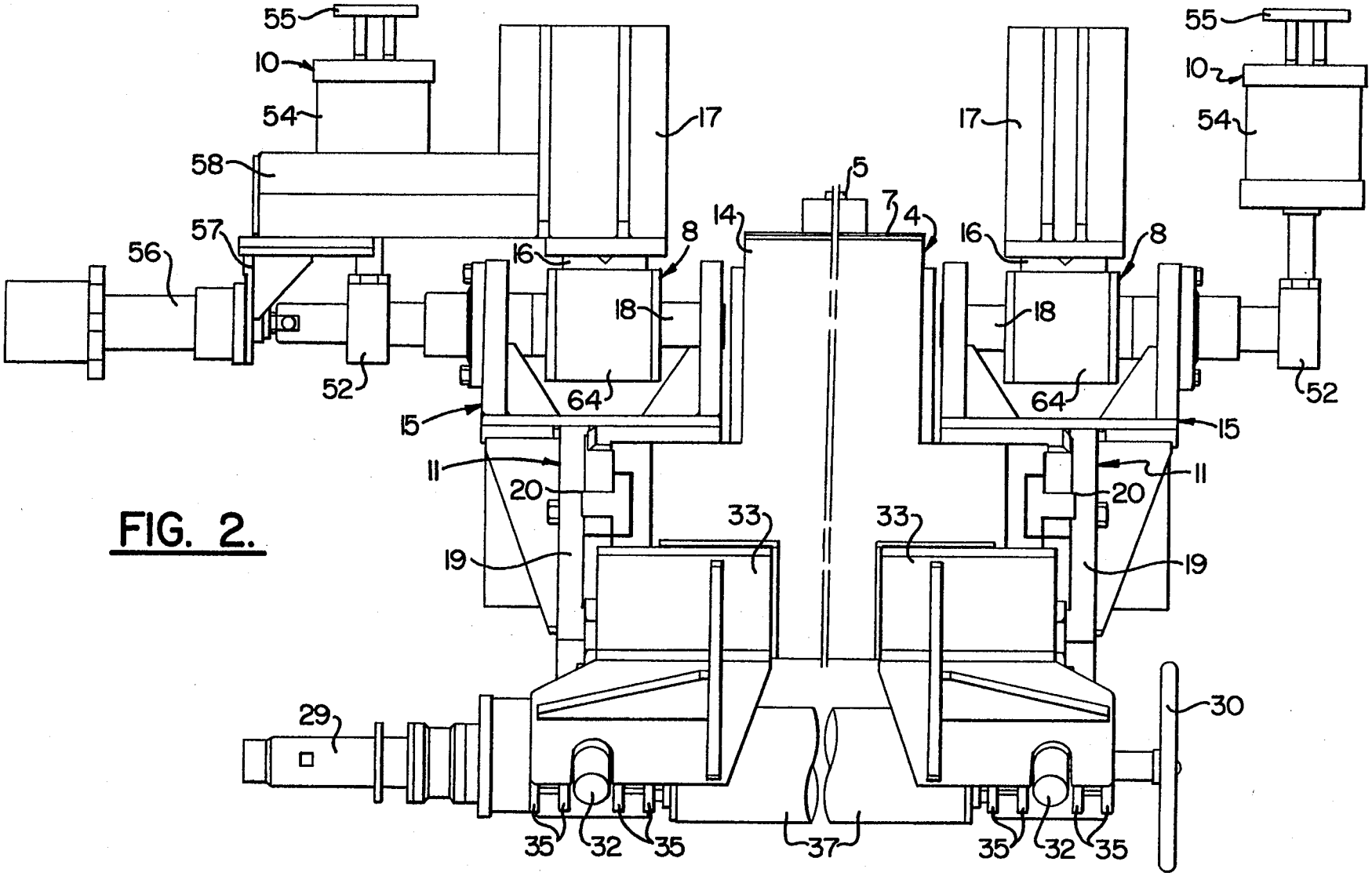
FIG. 2 is a longitudinal elevational view of the apparatus as viewed from line II—II in FIG. 1.
Figure 3:
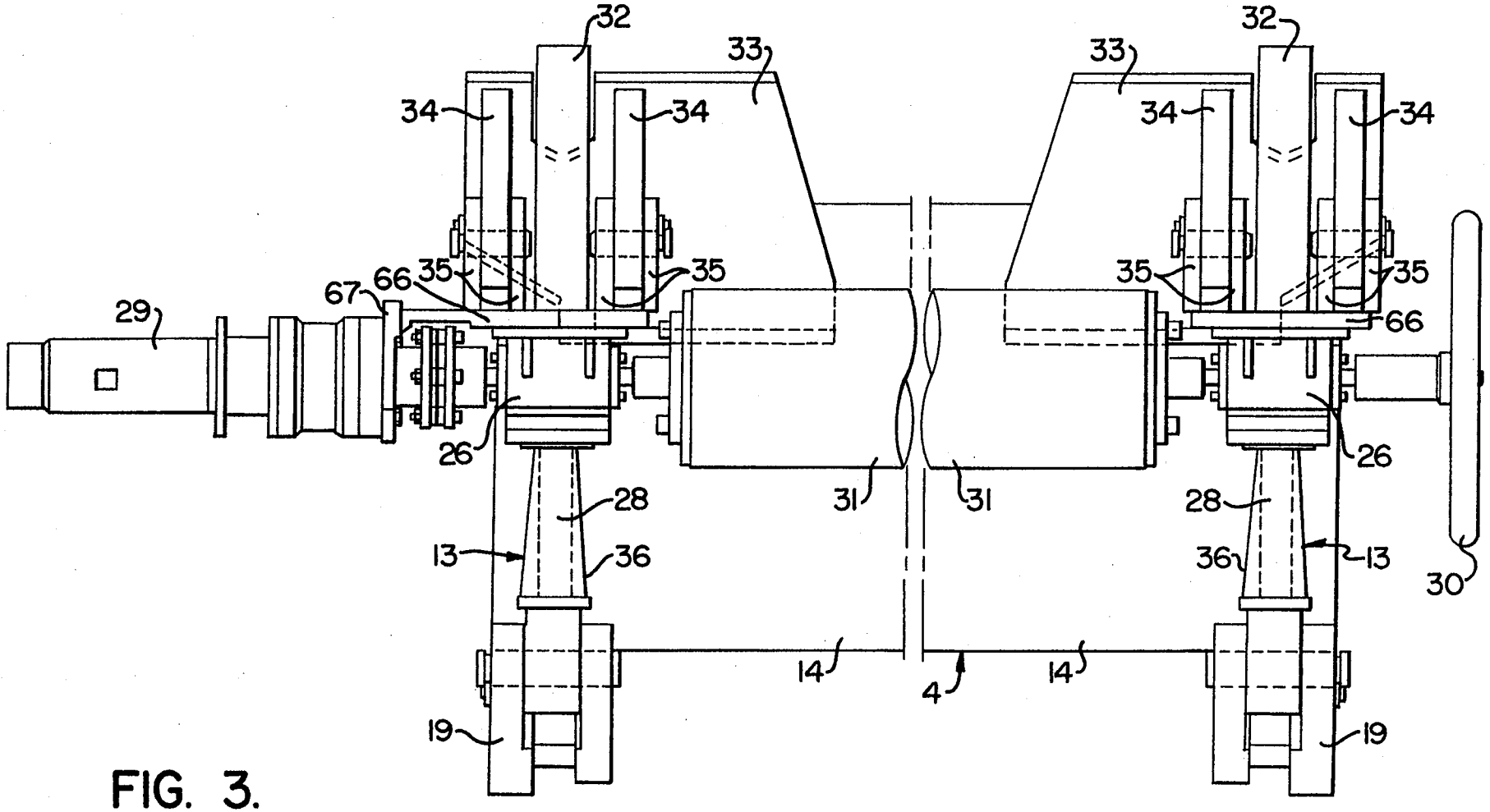
FIG. 3 is a longitudinal elevational bottom view of the apparatus as viewed from line III—III in FIG. 1.

FIGS. 1 to 3 are different views of an apparatus for adjusting the creping conditions when creping off a paper web 1 by means of a creping doctor 4 from a paper machine creping surface 2, to which the paper web 1 adheres. As a rule, the creping surface 2 is the cylinder surface of a Yankee dryer 3. The creping doctor 4 has an elongate doctor blade 5 with a working edge 6 that is shown most clearly in FIG. 12. The doctor blade extends over the width of the web 1 and is mounted in a bladeholder 7, which in the illustrated embodiment is of the type marketed under the trade name Conformatic by Lodding Engineering Corporation, Auburn, Mass., U.S.A., and is disclosed in FIG. 2 of U.S. Pat. No. 3,778,861 to Goodnow, incorporated herein by reference.

Figure 9:
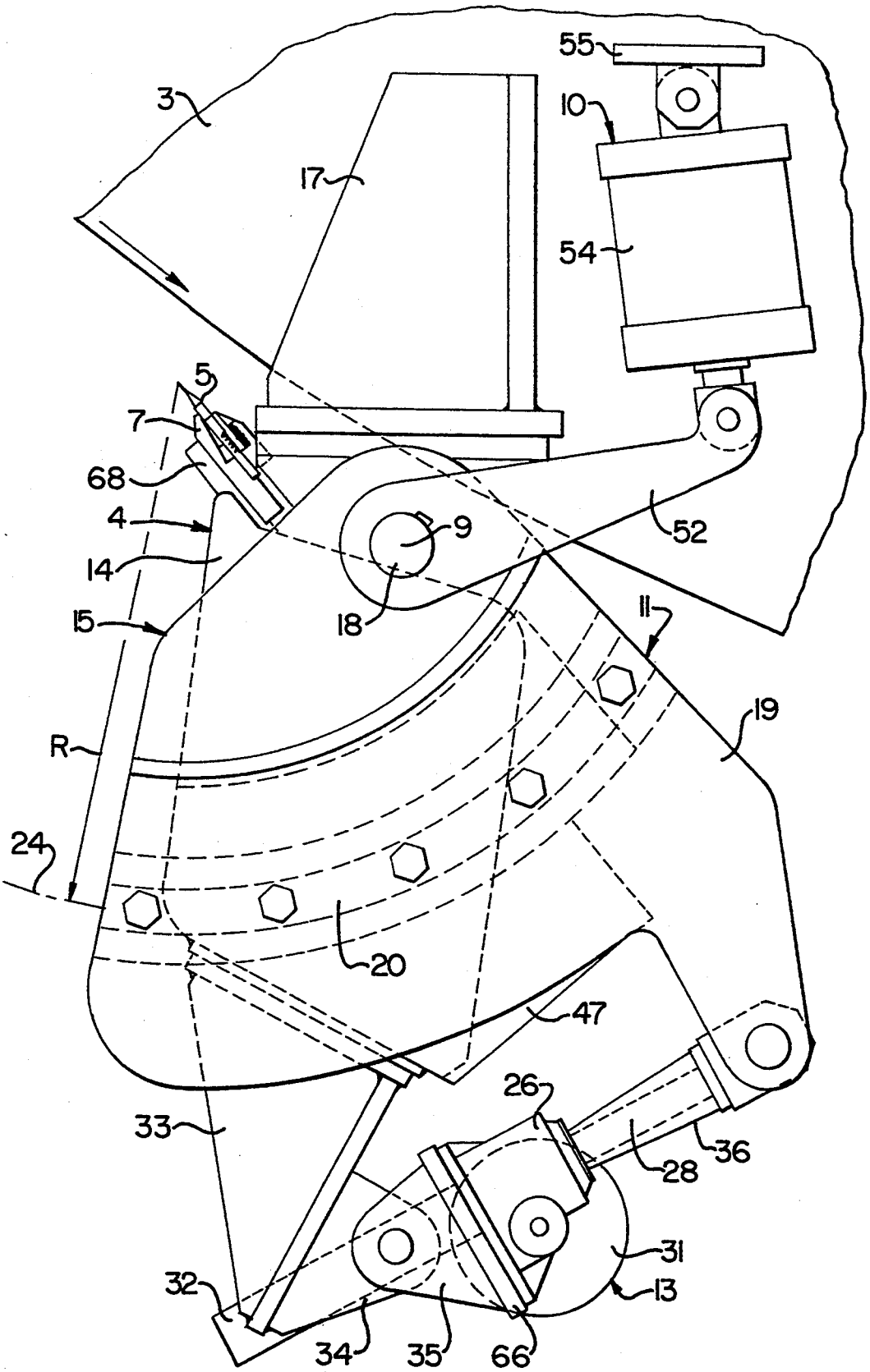
FIG. 9 is a side elevational view similar to FIG. 1 and illustrating the creping doctor apparatus when pivoted to an inactive position permitting the exchange of a worn doctor blade.

The creping doctor apparatus has means, generally designated 8, for defining a first rotational axis 9 for the creping doctor 4 parallel to the blade working edge 6 and located at a distance of at least 0.2 meters therefrom for permitting the doctor blade to be pivoted to an active first position, as shown in FIG. 1, for creping off the web 1, and an inactive second position, as shown in FIG. 9, in which a worn doctor blade may be removed from the bladeholder 7 and a fresh doctor blade 5 inserted thereinto. Means, generally designated 10, are provided for pivoting the creping doctor 4 on the first rotational axis 9.

The creping doctor apparatus further has means, generally designated 11, for defining a second rotational axis 12 parallel to the blade working edge 6 and located within 15 millimeters therefrom for permitting the setting of an arbitrary impact angle A formed at the blade working edge 6 between an impact surface of the working edge 6 and the creping surface 2 (or more correct a tangent to the creping surface at a point where the working edge contacts the creping surface).

Means, generally designated 13, are provided for pivoting the creping doctor 4 on the second rotational axis 12 to set the impact angle A.

In accordance with the present invention the creping doctor 4 includes an elongate beam member 14 having two ends and carrying the bladeholder 7. More specifically, the beam member 14 has a longitudinally extending integral fin 68, on which the bladeholder 7 is attached by means of screws, not shown. The means 8 for defining the first rotational axis 9 include two coaxial pivot pin devices, generally designated 15, connected to the beam member 14, one at each end thereof, and means, generally designated 16, for supporting the pivot pin devices 15. The supporting means 16 are adapted to be secured to a paper machine frame member, a portion of which is shown in the drawings and designated 17. Each pivot pin device 15 includes a pivot pin be and an end wall 19, which is non-rotatably and perpendicularly secured to the pivot pin 18. The two end walls 19 are located parallel to each other, one immediately outside each end of the elongate beam member 14.

The means 11 for defining the second rotational axis 12 include means, generally designated 20, for guiding a lateral displacement of the beam member 14 in a direction parallel to the two end walls 19. These guiding means 20 include, for each pair of beam member end and associated end wall 19, structural portions 21 and 22 that define a first guide member 23 of elongated shape extending along a circular arc 24 having a radius of curvature R, which starts from the desired location of the second rotational axis 12. The guiding means 20 further include a second guide member 25 adapted to the shape of the first guide member 23 and cooperating therewith. The two guide members 23 and 25 are interlocking to permit movement of the one in relation to the other exclusively along the circular arc 24, and one of the guide members, in the shown embodiment guide member 23, is provided on the beam member 14, and the other guide member is provided on the end wall 19, thereby forming a pivotal connection (around axis 12) between each pivot pin device 15 and the adjacent end of beam member 14.

The means 13 for pivoting the creping doctor 4 on the second rotational axis 12 are operatively connected between the beam member 14 and the end walls 19 for displacing the beam member 14 in a lateral direction parallel to the end walls 19, and the means 10 for pivoting the creping doctor 4 on the first rotational axis 9 are supported by the paper machine frame member (at a position not shown) and operatively connected to rotate the pivot pins 18.

Figure 12:
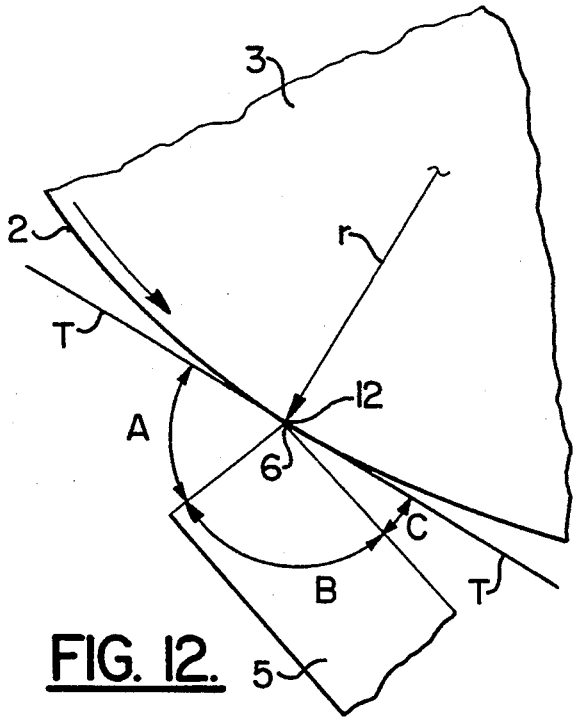
FIG. 12 is an enlarged scale, fragmentary side elevational view of a doctor blade having its tip in contacting relation with the cylinder surface of a Yankee dryer as shown in FIG. 1, for example, and in which the thickness of the doctor blade is greatly exaggerated relative to the radius of the cylinder surface.

FIG. 12 illustrates the operative relationship between the doctor blade 5 and the Yankee dryer 3. To facilitate identification of the various angular relationships and angles, the thickness of the blade is greatly exaggerated with respect to the radius r of the Yankee dryer. Commonly used creping doctor blades as a rule have a thickness on the order of 1.2 millimeters while the diameter of the Yankee dryer can vary from about 3 meters to about 5.5 meters or more. In FIG. 12 the tip of the doctor blade 5 is shown as being cut perpendicularly, but many soft crepe paper producers prefer to use a bevelled tip having an included angle B of less than 90° and, therefore, the surface of the doctor blade 5 to which the impact angle A is measured is commonly called the bevel surface. As used herein, the impact angle A is the plane angle defined by the bevel surface of the doctor blade 5 and by the upstream segment of a plane tangent T to the cylinder surface 2 of the Yankee dryer 3 at the point of intersection of cylinder surface 2 and doctor blade 5, and the set-up angle C is the plane angle defined by the rear side of the doctor blade 5 and by the downstream segment of the tangent T. Typically, the impact angle A is from about 80° to about 95°, the included angle B of the blade tip is from 90° to about 60°, and the set-up angle C is from about 15° to about 30°. The impact angle controls the result of the creping operation, i.e. among other parameters the caliper and the macrostructure of the creped paper web. During operation the working edge 6 of the doctor blade 5 is being worn, which causes a change in the impact angle A. To maintain the desired caliper and/or the desired macrostructure as far as possible it is necessary to compensate for the wear of the blade working edge 6 by pivoting the doctor blade 5 substantially around its working edge 6 so as to maintain the impact angle A. According to the present invention the impact angle is adjusted by pivoting the creping doctor 4 on the second rotational axis which is located within 15 millimeters from the working edge 6 and preferably coincides with said working edge.

Figure 7:
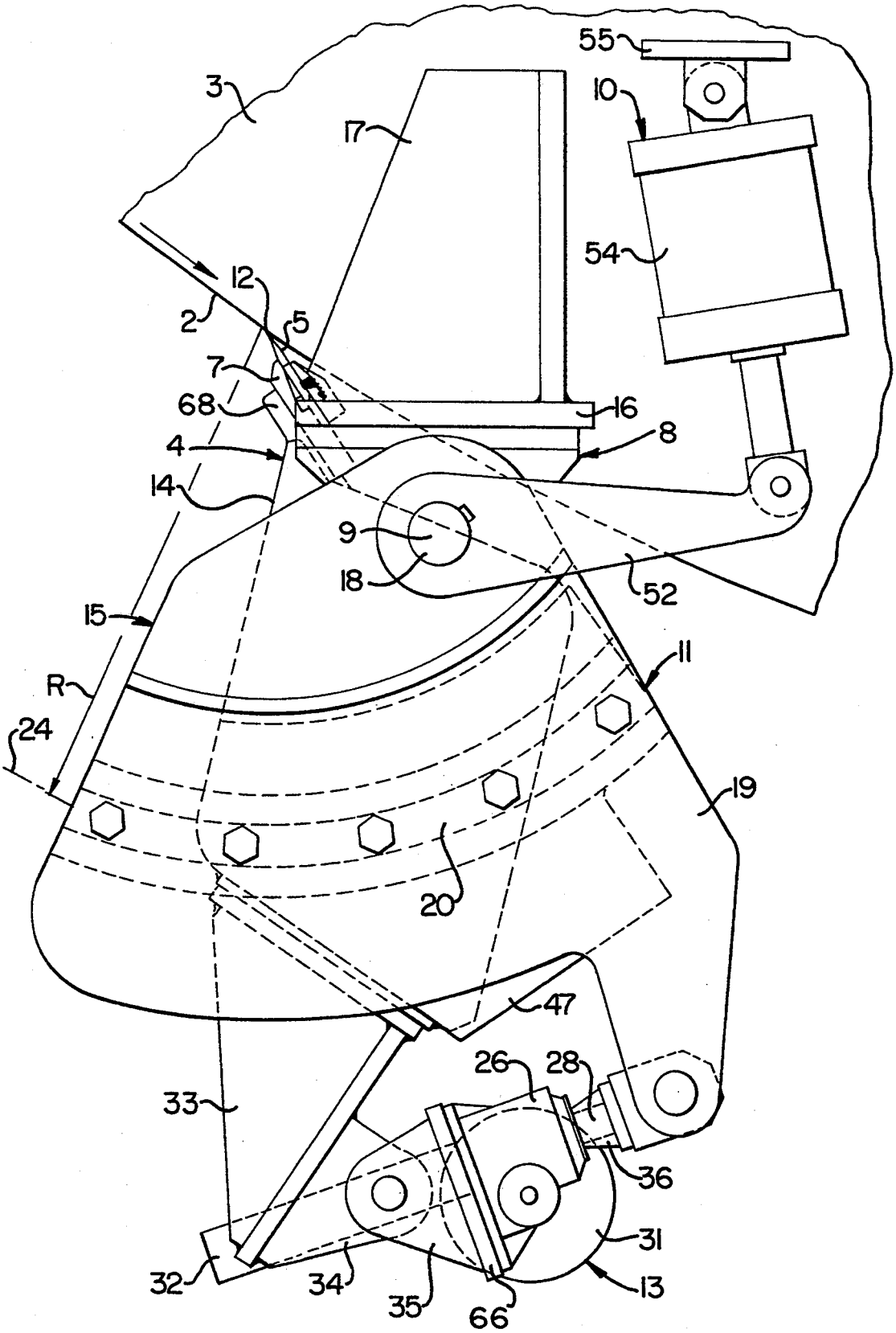
FIG. 7 is a side elevational view similar to FIG. 1 and illustrating the creping doctor as pivoted around the tip of the doctor blade to set a maximum impact angle.
Figure 8:
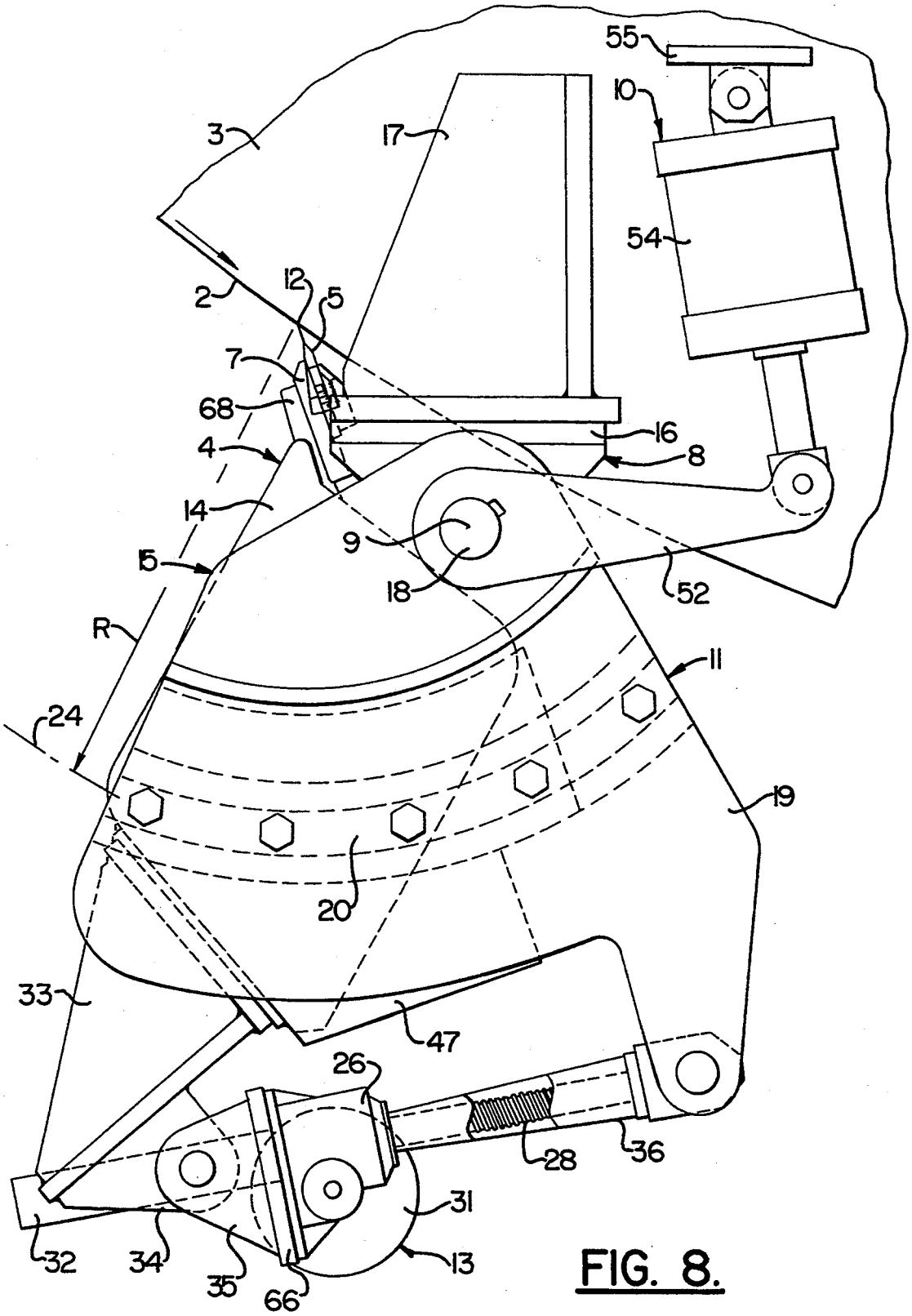
FIG. 8 is a side elevational view similar to FIG. 1 and illustrating the creping doctor as pivoted around the tip of the doctor blade to set a minimum impact angle.

While FIG. 1 illustrates the creping doctor apparatus of the present invention when the set-up angle, which above is designated C, is about 22.5°, FIGS. 7 and 8 show the apparatus after the creping doctor 4 has been pivoted around the working edge of the doctor blade to a right-hand end position, which results in a minimum set-up angle of about 15°, and to a left-hand end position, which results in a maximum set-up angle of about 30°, respectively. Assuming that the included angle of the blade tip is 70°, for example, the above values of the set-up angle correspond to an impact angle of 87.5°in FIG. 1, and of 95° and 80° in FIGS. 7 and 8, respectively. FIGS. 7 and 8 clearly illustrate how the creping doctor 4 and its beam member 14, which is indicated in broken lines behind the end wall 19, shift their position in relation to the end wall 19 in order to adjust the set-up angle and, consequently, the impact angle. A lateral displacement of the creping doctor 4 in a direction parallel to the planes of the end walls 19 does not affect the positions of the two end walls 19.

Preferably, the means 13 for pivoting the creping doctor 4 on the second rotational axis 12 include two rotary to translatory motion transforming mechanisms 13, one located at each end of the beam member 14. Each mechanism 13 comprises a housing 26 pivotally secured to the beam member 14; a drive member rotatably journaled in the housing 26; an elongate positioning driven member 28 (shown in FIG. 8) extending through the housing 26 in meshing engagement with the drive member, said driven member 28 having one end non-rotatably and pivotally secured to the end wall 19 of the adjacent pivot pin device 15 in a position such that the driven member 28 extends substantially parallel to a tangent (not shown) to the guiding means 20, said driven member 28 being displaced longitudinally upon rotation of the drive member; and means 29 and/or 30 for rotating the drive member.

Different types of motion transforming mechanisms may be used, e.g. one in which the drive member is a pinion and the driven member is a rack, but preferably the mechanism is an anti backlash screw jack 13, the drive member is a nut, and the driven member is a positioning screw 28 (FIG. 8) extending through the nut. A suitable screw jack is the anti backlash actuator marketed by Duff Norton Co., Charlotte, N.C., USA, under the designation SK-9005-501X. It is also preferred that means 31 are provided for mechanically interconnecting the two motion transforming mechanisms 13 in a manner such that a rotation of one of the drive members causes a corresponding rotation of the other one. The interconnecting means may be a shaft, suitably a tubular shaft 31 in order to optimize weight and torsional stiffness to each other.

The free end portion of the positioning screw 28 is surrounded by a protective tube 32 secured to the housing 26 and having a closed end. For securing the two housings 26 pivotally to the beam member 14, two brackets 33 are fixed to a bottom surface of the beam member 14, one at each end of the beam member 14. Each bracket 33 has two identical parallel lugs 34, which are journaled in two pillow blocks 35 fixed in diametrically opposed positions, one on each side of the protective tube 32, on a common bottom plate 66 attached to the housing 26. The other screw end portion, which is pivotally attached to the end wall 19, is surrounded by an axially deformable protective sheath 36 that may be a bellows, for example, but in the shown embodiment is a steel strip wound into a tight spiral and having its inner end fixed to the housing 26 and its outer end fixed to the pivotally attached end of the screw 28. A protective sheath of this kind is marketed under the trade mark CentryCover by Centryco. Centrexport & Central Safety Equipment Co. Inc., Burlington, N.J., USA.

Figure 4:
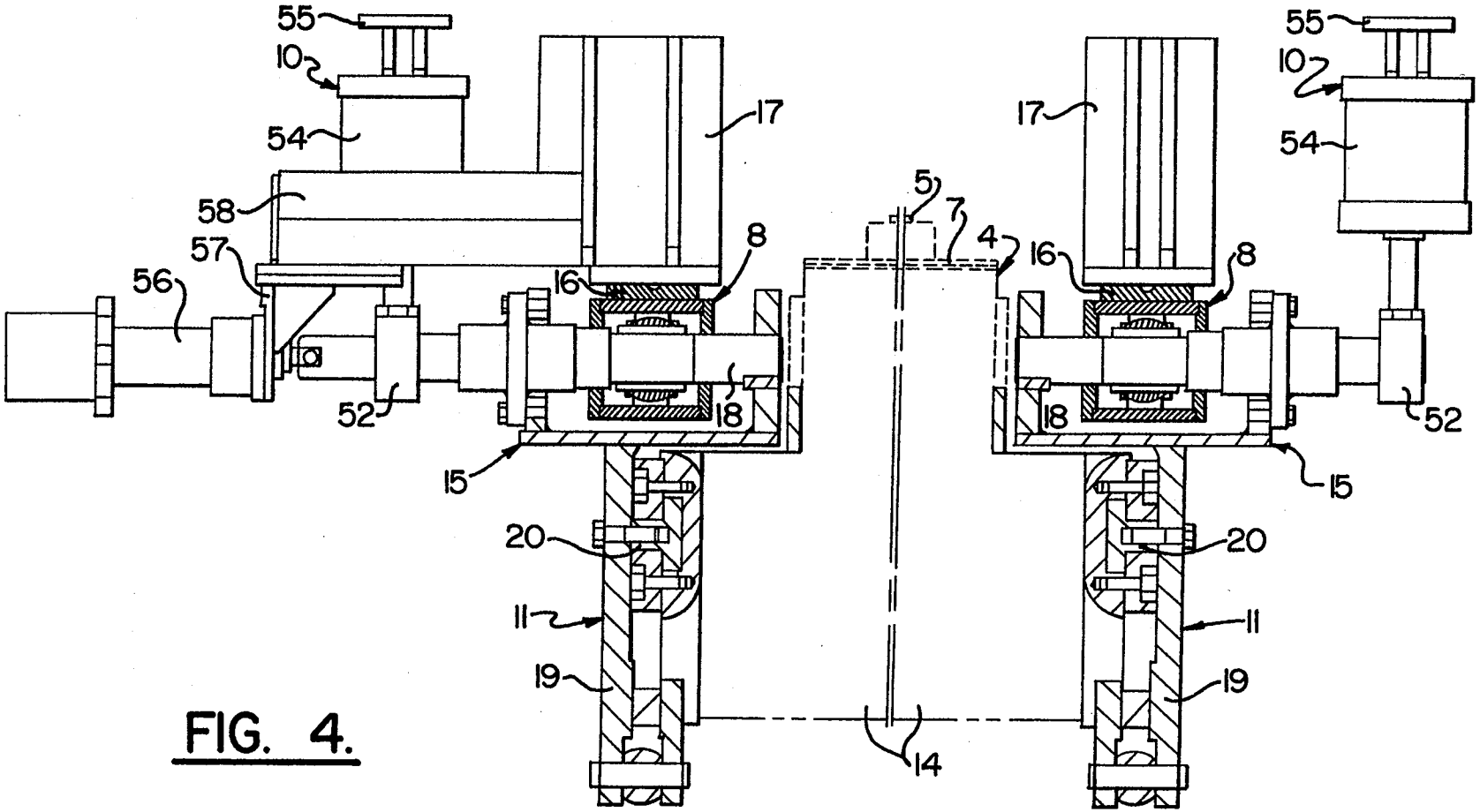
FIG. 4 is a cross sectional view of the apparatus taken upon line IV—IV of FIG. 1.
Figure 5:
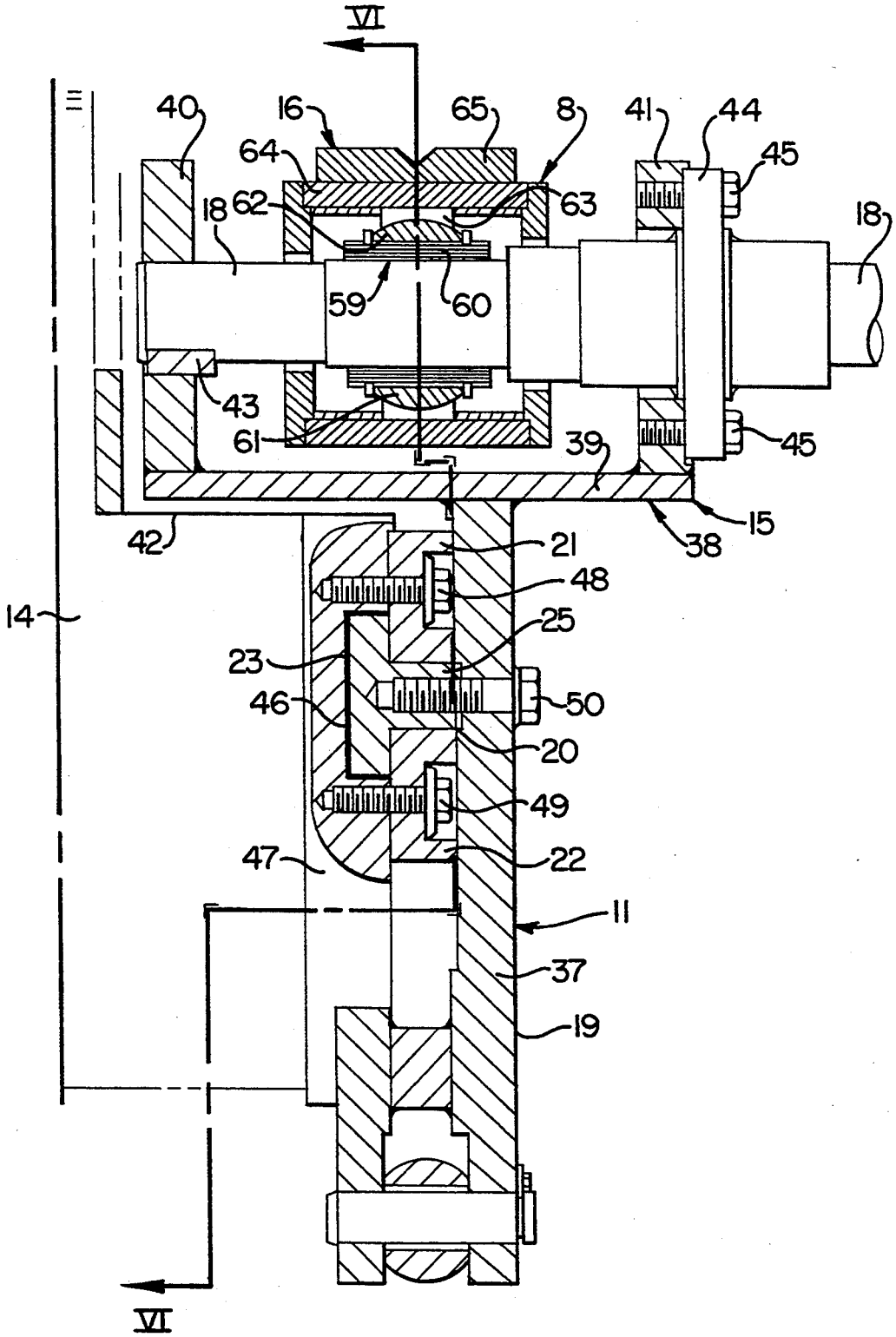
FIG. 5 is an enlarged scale detail of a portion of FIG. 4 and shows the guiding means, which guide the pivotal movement of the creping doctor around the tip of the doctor blade, the bearing means provided for the oscillation of the creping doctor, and the supporting means provided for permitting tipping of the apparatus for exchange of a worn doctor blade and oscillation.

Of the two means for rotating the drive member, one is a motor 29 and the other is a hand-wheel 30. The motor 29, which has a step-down gear with a considerable reduction ratio, is located on the drive side of the paper machine and is supported by a bracket 67 integral with the bottom plate 66 of the two pillow blocks 35 shown in the left-hand portion of FIG. 3. Each of the two screw jacks 13 has a through drive shaft having an inner and an outer end. The inner ends are interconnected by means of the intermediate shaft 31 the step-down gear of motor 29 is connected to one of the outer shaft ends, and the hand-wheel 30 is connected to the other outer shaft end. Consequently, the hand-wheel 30 is located on the operational side of the paper machine. The hand-wheel 30 is used for manually adjusting the impact angle A of the doctor blade in case the motor 29 should fall out for some reason. As best shown in FIGS. 4 and 5, each of the end walls 19 has a lower plate-shaped portion 37 and an upper channel-shaped portion 38 fixed to the plate-shaped portion 37. The channel-shaped portion 38 has a bottom wall 39 and two side walls 40 and 41. The bottom wall 39 is curved so as to make all portions thereof equidistantly spaced from the second rotational axis 12, which is located at the working edge 6 of the doctor blade, while the two side walls 40 and 41 are parallel to each other and to the lower plate-shaped portion 37 of the end wall 19. As to shape, the channel-shaped portion 38 has a symmetry plane, which is parallel to the plate-shaped portion 37 but located on the beam member side thereof. To accommodate the part of the channel-shaped portion 38 that is located next to the beam member 14, the beam member is provided with a corresponding recess 42 with sufficient clearance to the bottom wall 39 and the adjacent side wall 40 of the channel-shaped portion 38 to permit the lateral movement of the beam member 14 in a direction parallel to the end walls 19.

Each of the pivot pins 18 has one end fixed in the side wall 40, in the shown embodiment by means of a key 43, and extends through the other side wall 41, where it is axially fixed by means of a welded-on flange 44 that is secured to the side wall 41 by suitable fasteners, such as screws 45.

In the embodiment shown in FIGS. 5 and 6 the first guide member 23 is a guide slot located in the beam member 14 end below the recess 42, and the second guide member 25 is guide rail adapted to the shape of the guide slot and located on the lower plate-shaped portion 37 of the end wall 19. The illustrated guide slot 23 is of T-shaped cross section and is formed by a groove 46 of rectangular cross section provided in an end wall 47 of the beam member 14 and an upper and a lower guide plate 21 and 22, respectively, which are adjustably mounted on the end wall 47 of the beam member 14, e.g. by a series of screws 48 and 49, respectively, and partly cover the groove 46 along its length to define the T-shaped cross section of the guide slot 23. Consequently, also the guide rail 25 is of T-shaped cross section, and it is mounted on the lower plate-shaped portion 37 of the end wall 19 by means of a series of screws 50. The guide rail 25 does not touch the bottom or the sides of the groove 46. The guiding effect is provided exclusively by the two adjustable guide plates 21 and 22, the guide rail 25 and the associated surfaces of the end wall 19. A plurality of grease nipples and conduits, not shown, are provided for lubrication of the guide surfaces.

Figure 6:
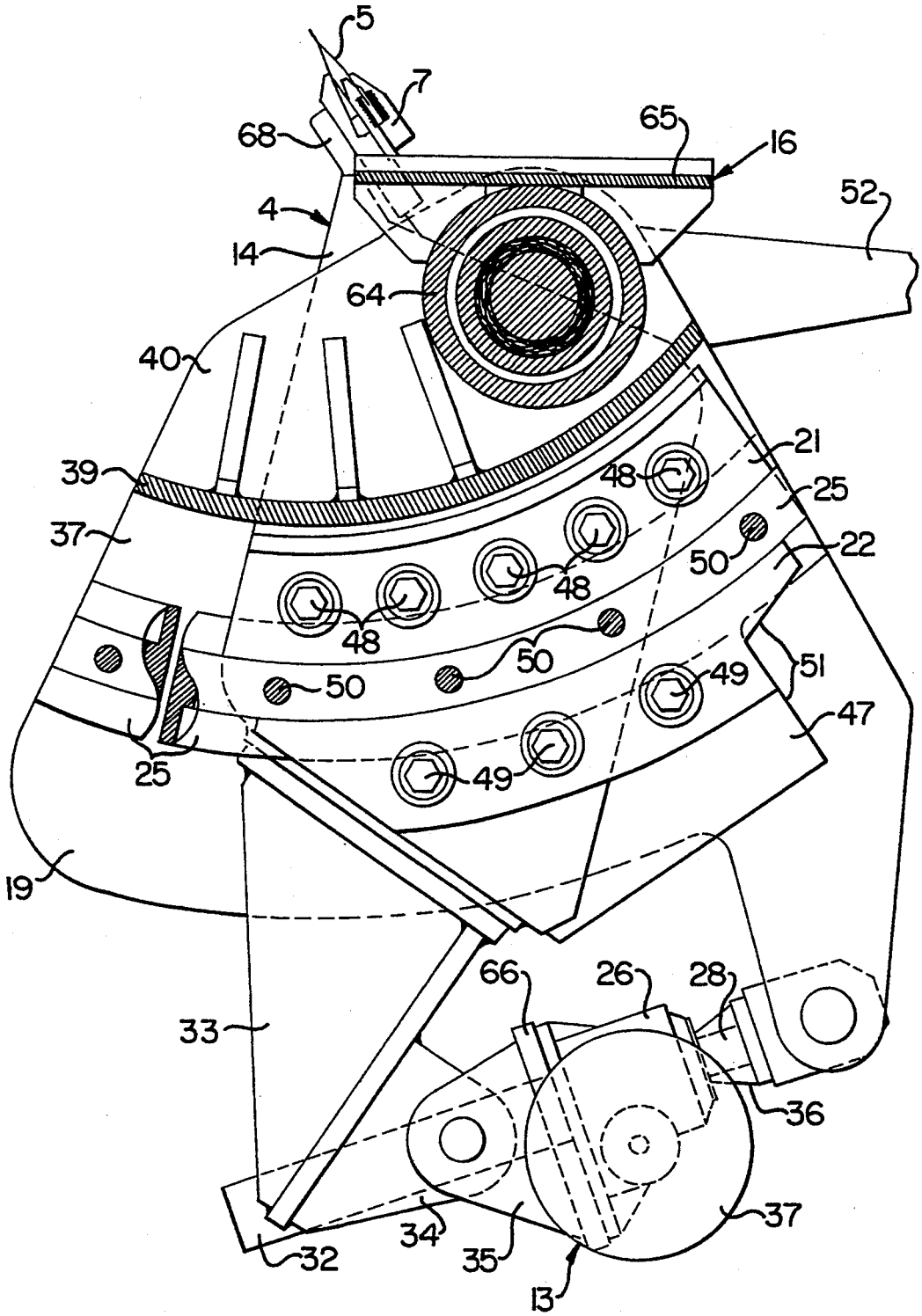
FIG. 6 is a cross sectional view taken upon line VI—VI of FIG. 5.

While the illustrated beam member 14 is of substantially rhomboidal cross section, its end walls 47 extend outside thereof, on the right-hand side as viewed in FIG. 6, to provide adequate support and attachment points for the two guide plates 21 and 22. A recess 51 is provided in the right-hand corner of the beam member end wall 47 as viewed in FIG. 6 in order to permit the mounting of a shower tube, not shown, between the two end walls 19 for showering the cylinder surface 2 of the Yankee dryer 3 when the creping doctor 4 is non-operational.

The means 10 for pivoting the creping doctor 4 on the first rotational axis 9 include on each side of the paper machine a lever 52 and an actuator 54. The lever 52 is non-rotatably secured by means of a key 53, shown in FIG. 1, to the free end of the right-hand pivot pin 18 as viewed in FIGS. 2 and 4. The left-hand pivot pin has an extended free end, which projects axially from an identical lever secured non-rotatably to the left-hand pivot pin. The free end of each lever 52 is pivotally connected to the associated actuator 54, which is pivotally mounted in a pillow block 55 adapted to be anchored to a bracket, not shown, that is included in the paper machine frame member 17. The two actuators 54 are used for pivoting the creping doctor on the pivot pins 18 between two positions, namely an active one, in which the doctor blade 5 engages the cylinder surface 2 of the Yankee dryer 3 as shown in FIG. 1, and an inactive one, in which the doctor blade 5 is swung out from the cylinder surface 2, as shown in FIG. 9, to permit the replacement of a worn blade. On comparison of FIG. 9 to FIG. 1 it is evident that the pivoting of the entire apparatus by means of the actuators 54 does not affect the position of the creping doctor 4 and its beam member 14 (shown in broken lines) in relation to the position of the end wall 19.

The extended free end of the left-hand pivot pin 18 as viewed in FIGS. 2 and 4 is operatively connected to an oscillator 56 for continuously oscillating the creping doctor 4 in order to avoid the formation of grooves in the creping surface 2. The oscillator 56 is mounted on a bracket 57 carried by an arm 58 mounted to the paper machine frame member 17. As a rule, the movement effected by the oscillator is on the order of 6 to 18 millimeters at a suitable frequency, such as 15 strokes per minute, for example.

For permitting axial oscillation of the creping doctor 4 relative to the supporting means 16, bearing means 59 are provided in association with each of the pivot pin devices 15 and the adjacent supporting means 16 as is best shown in FIGS. 4 and 5. Each bearing means 59 includes a bushing 60 that is axially displaceable on a portion of the pivot pin 18 located half-way between the two side walls 40 and 41 of the channel-shaped portion 39 of the end wall 19. The supporting means 16 includes a self-aligning bearing 61 having an inner ring 62, which is mounted on the bushing 60, and an outer ring 63, a surrounding housing 64 in which the outer ring 63 is mounted, and a bracket member 65 to which the housing 64 is secured. The bracket member 65, which may be integral with the housing 64, is adapted to be secured to the frame member 17 of the paper machine and is shown mounted to the frame member. Each of the two self-aligning bearings 61 has a central symmetry plane, which extends perpendicularly to the first rotational axis 9 for the creping doctor 4 and coincides with the uppermost portion of line VI—VI in FIG. 5, and each of the positioning screws 28 has a center line, not indicated. These center lines are located one in each of the two central symmetry planes of the two self-aligning bearings 61.

Figure 10:
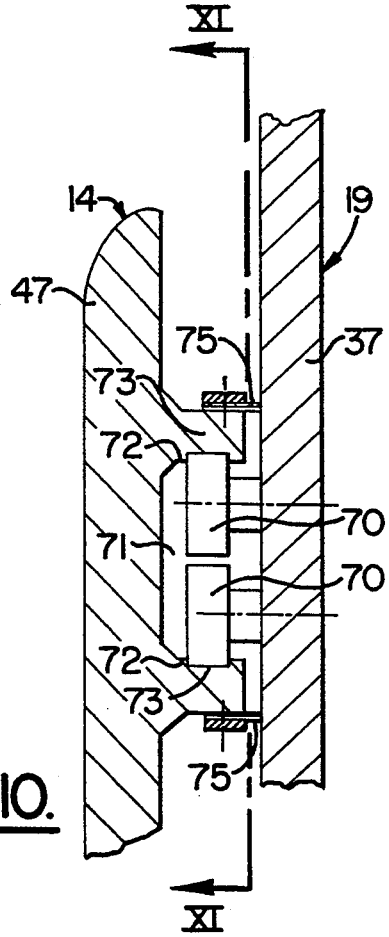
FIG. 10 is a fragmentary cross sectional view illustrating an alternative embodiment, in which two rows of guide rollers are substituted for the guide rail disclosed in FIGS. 5 and 6.
Figure 11:
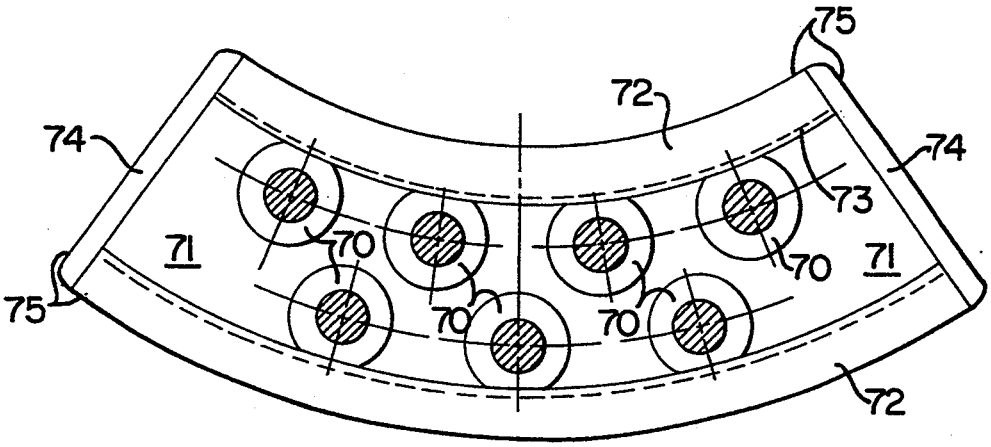
FIG. 11 is a fragmentary cross sectional view taken upon line XI—XI of FIG. 10.

Also in the embodiment shown in FIGS. 10 and 11 the first guide member 23 is a circularly arched guide slot, here designated 71, located in the end wall 47 of the beam member 14, but the second guide member includes two circularly arched rows of guide rollers 70 instead of being a guide rail. The guide rollers 70 are adjustably mounted to the lower plate-shaped portion 37 of the end wall 19 by means of screws, not shown. The guide slot 71 is defined by two circularly arched opposed side walls 72 extending parallel to each other, and in each of the side walls 72 there is provided a recessed raceway 73 for the rollers 70. The cooperation between the guide rollers 70 and the recessed raceways 73 provides an interlocking effect that permits movement of the beam member 14 in relation to the end wall 19 exclusively around the second rotational axis 12 at the working edge 6 of the doctor blade 5. An end cover 74 is provided at each end of the guide slot 71, and in order to seal off the guide slot from the environment, a flat rubber seal ring 75 is mounted on the exterior side of the two side walls 72 and the end covers 74 and bridges a clearance to the lower plate-shaped portion 37 of the end wall 19.

While the present invention above has been described with reference to the drawings, which show two preferred embodiments, several modifications thereof are possible within the scope of the appended claims. As an illustrative example it should be apparent that the embodiment disclosed in FIGS. 10 and 11 can be modified by eliminating the guide slot and substituting a single guide rail for the two side walls that presently define the guide slot, and by locating the recessed raceways for the two rows of guide rollers on opposite sides of the single guide rail. The end covers could remain substantially unchanged, but to permit the mounting of the flat rubber seal ring, the beam member end wall could be provided with two fin members serving to connect the two ends of the one end cover with the two ends of the other. It would also be possible, but less preferred, to use another type of means than the disclosed screw jack for pivoting the creping doctor on the second rotational axis. For example, with the exception of a lug for the attachment of the positioning screw of the screw jack, the bottom portion of the end wall is circularly curved around the second rotational axis at the working edge of the doctor blade. The lug could be dispensed with, the curved bottom portion of the end wall could be provided with teeth to form a toothed rack member, and a stepdown gear having a drive pinion meshing with the toothed rack member could be installed. A rotation of the pinion would displace the pinion along the toothed rack member and, thus, pivot the creping doctor substantially around the working edge of the doctor blade.

What is claimed is:

1. An apparatus for adjusting the creping conditions when creping off a paper web by means of a creping doctor from a paper machine creping surface to which the paper web adheres, said creping doctor having an elongate doctor blade with a working edge and mounted in a bladeholder and extending across the width of the web, said apparatus having means for defining a first rotational axis for the creping doctor parallel to the blade working edge and located at a distance from the creping surface to permit the blade to be pivoted to an active first position for creping off the web and an inactive second position, in which a worn blade may be removed from the bladeholder and a fresh blade inserted thereinto, said apparatus further having means for pivoting the creping doctor on said first rotational axis, means for defining a second rotational axis parallel to the blade working edge, said second rotational axis being coincident with said blade working edge or within 15 millimeters therefrom for permitting the setting of an arbitrary impact angle formed at the blade edge between an impact surface of the blade edge and the creping surface, and means for pivoting the creping doctor on said second rotational axis to set the impact angle, said apparatus comprising an elongate beam member included in the creping doctor and having two ends, said bladeholder being carried by the beam member, said means for defining the first rotational axis including two coaxial pivot pin devices connected to the beam member, one at each end thereof, and means associated with the pivot pin devices for supporting the same, said supporting means being adapted to be secured to a frame member of the paper machine, each pivot pin device and its associated supporting means forming a pair, and each pivot pin device including a pivot pin and an end wall non-rotationably and perpendicularly secured to the pivot pin, said end walls being located parallel to each other, one immediately outside each end of the elongate beam member, said means for defining the second rotational axis including means for guiding a lateral displacement of the beam member in a direction parallel to the two end walls, said guiding means including, for each pair of beam member end and associated end wall, structural portions that define a first guide member of elongated shape extending along a circular arc having a radius of curvature, which starts from the desired location of the second rotational axis, and a cooperating second guide member adapted to the shape of the first guide member, said two guide members being interlocking to permit movement of the one in relation to the other exclusively along said circular arc, one of said guide members being provided on the beam member and the other guide member being provided on the end wall, thereby forming a pivotal connection around said second rotational axis between each pivot pin device and the beam member ends, said means for pivoting the creping doctor on the second rotational axis being operatively connected between the beam member and the end walls for displacing the beam member in a lateral direction parallel to the end walls, and said means for pivoting the creping doctor on the first rotational axis being supported by the paper machine frame member and operatively connected to rotate the pivot pins.

2. An apparatus as claimed in claim 1, wherein said means for pivoting the creping doctor on the second rotational axis include two rotary to translatory motion transforming mechanisms, one located at each end of the beam member, each mechanism comprising (a) a housing pivotally secured to the beam member;

(b) an elongate positioning member extending through the housing, said positioning member having one end non-rotatably and pivotally secured to an adjacent one of the end walls of said two pivot pin devices in a position such that the positioning member extends substantially parallel to a tangent to said guiding means; and (c) means for displacing said positioning member longitudinally in relation to the housing.

3. An apparatus as claimed in claim 2, wherein said mechanism is a screw jack, and said positioning member is a positioning screw included in the screw jack.

4. An apparatus as claimed in claim 2, further comprising means for mechanically interconnecting the two motion transforming mechanisms in a manner such that a longitudinal displacement of one of the positioning members causes a corresponding longitudinal displacement of the other one.

5. An apparatus as claimed in claim 1, further comprising bearing means for permitting axial oscillation of the creping doctor relative to the supporting means, said bearing means being provided in association with each pair of pivot pin device and associated supporting means.

6. An apparatus as claimed in claim 5, wherein each bearing means includes a bushing that is axially displaceable on a portion of the pivot pin, and said supporting means includes a self-aligning bearing having an inner ring, which is mounted on the bushing, and an outer ring, a surrounding housing in which the outer ring is mounted, and a bracket member to which the housing is secured, said bracket member being intended to be secured to said frame member of the paper machine.

7. An apparatus as claimed in claim 2, wherein said pivot pin device supporting means include two self-aligning bearings, which are associated one with each of the two coaxial pivot pin devices, each of said self-aligning bearings has a central symmetry plane extending perpendicularly to the first rotational axis for the creping doctor, and each of said driven positioning members has a center line, said center lines being located one in each of the two central symmetry planes of the two self-aligning bearings.

8. An apparatus as claimed in claim 1, wherein said first guide member is a guide slot, and said second guide member is a guide rail adapted to the shape of the guide slot.

9. An apparatus as claimed in any claim 1, wherein said first guide member is a guide slot, said second guide member includes two rows of guide rollers, and said guide slot has two opposed side walls extending parallel to each other and forming raceways for the guide rollers of said two rows.

* * * * *